US006186703B1

(12) United States Patent
Shaw

(10) Patent No.: US 6,186,703 B1
(45) Date of Patent: Feb. 13, 2001

(54) MECHANICAL INTERLOCKING MEANS FOR RETAINING WALL

(75) Inventor: Kenneth L. Shaw, Colleyville, TX (US)

(73) Assignee: Shaw Technologies, Colleyville, TX (US)

( * ) Notice: Under 35 U.S.C. 154(b), the term of this patent shall be extended for 0 days.

(21) Appl. No.: 09/267,038

(22) Filed: Mar. 12, 1999

Related U.S. Application Data

(60) Provisional application No. 60/077,724, filed on Mar. 12, 1998.

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS

| | | | | |
|---|---|---|---|---|
| 3,686,873 | | 8/1972 | Vidal | 405/262 |
| 4,116,010 | | 9/1978 | Vidal | 405/262 |
| 4,324,508 | | 4/1982 | Hilfiker et al. | 405/284 |
| 4,449,857 | | 5/1984 | Davis | 405/286 |
| 4,470,728 | | 9/1984 | Broadbent | 405/284 |
| 4,725,170 | | 2/1988 | Davis | 405/286 |
| 4,929,125 | | 5/1990 | Hilfiker | 405/262 |
| 4,952,098 | * | 8/1990 | Grayson et al. | 405/262 |
| 4,993,879 | * | 2/1991 | Hilfiker | 405/262 |
| 5,044,833 | * | 9/1991 | Hilfiker | 405/286 |
| 5,131,791 | * | 7/1992 | Kitziller | 405/286 |
| 5,259,704 | * | 11/1993 | Orgorchok | 405/262 |
| 5,451,120 | * | 9/1995 | Martinez-Gonzalez | 405/262 |
| 5,975,810 | * | 11/1999 | Taylor et al. | 405/286 |

FOREIGN PATENT DOCUMENTS 201622 8/1923 (GB) .

* cited by examiner

*Primary Examiner*—Eileen Dunn Lillis
*Assistant Examiner*—Frederick L Lagman
(74) *Attorney, Agent, or Firm*—Smith & Danamraj, PC

(57) ABSTRACT

An improved method and system for attaching a welded wire grid-work panel to a plurality of face panels of a retaining wall. The method first begins by providing a plurality of stackable face panels, each face panel having a plurality of anchor links fixed within a back portion of the face panels. Each of the anchor links forms a vertical loop extending outwardly generally perpendicular to the back portion of the face panels. Additionally, each anchor link includes two legs extending laterally from each anchor link within the face panel. Next, a first tier of the face panels is disposed at the bottom of the embankment being erected. Soil is then back-filled behind the first tier of panels to a level of the anchor links disposed within the first tier of face panels. A welded wire grid-work panel, which extends perpendicularly from the back portion of the face panels into a soil embankment, is positioned so that a plurality of wire loops at the edge of the grid-work panel aligns with the vertical loops. A connector rod is extended through the vertical loops of the anchor links and the wire loops of the grid-work panel. Next, additional soil is back-filled behind the first tier of face panels and over the anchor links, vertical loops, wire loops, and grid-work panel to a level at a top edge of the first tier of face panels. The method is repeated until the desired height of the embankment is attained.

9 Claims, 3 Drawing Sheets

MECHANICAL INTERLOCKING MEANS FOR RETAINING WALL

This application claims the benefit of U.S. Provisional Application No. 60,077,724, filed Mar. 12, 1998.

BACKGROUND OF THE INVENTION

1. Technical Field of the Invention

This invention relates to an improved method and system for use with earth retaining structures, and more particularly, an improved retaining wall link and loop combination for attaching a welded wire gridwork panel to the face panels of the wall. This utility patent application claims the priority date of Provisional Patent Application Ser. No. 60/077,724 filed Mar. 12, 1998 and is hereby incorporated by reference.

2. Description of Related Art

A retaining wall is used for retaining earth and/or other backfill material placed behind the wall. Elongated support structures normally extend from various locations on the back surface of the wall into the backfill material. The support members are embedded into the backfill material and prevent the wall from buckling outwardly.

The retaining wall may be constructed of an unbroken stretch of concrete which usually is poured on site. Alternatively, the wall may be constructed of a plurality of modular concrete blocks which are assembled on site. Generally, modular blocks are less expensive to construct and assemble than a large, single piece of concrete because of the difficulty in transporting and pouring large amounts of concrete. Additionally, the amount of time required for assembling the modular blocks is generally less than that required for pouring concrete walls.

A major difficulty is encountered in attaching the support members to the modular blocks. Several methods and apparatus have been provided in the past for attaching the support members to the modular blocks. However, installation of these prior art devices onto retaining walls is often tedious and time consuming. In addition, difficulties are encountered in providing a strong enough connecting device connecting the retaining wall with the support members, in order to support the heavy forces placed on the retaining wall. A system and method are needed for attaching support members to a modular block which are easy to install, and provides the requisite strength necessary to reinforce a retaining wall.

Although there are no known prior art teachings of a solution to the aforementioned deficiency and shortcoming such as that disclosed herein, prior art references that discuss subject matter that bears some relation to matters discussed herein are U.S. Pat. No. 4,324,508 to Hilfiker et al. (Hilfiker I), U.S. Pat. No. 4,449,857 to Davis (Davis I), U.S. Pat. No. 4,725,170 to Davis (Davis II), and U.S. Pat. No. 4,929,125 to Hilfiker (Hilfiker II).

Hilfiker I discloses welded wire grid work mats which are positioned within an earthen formation. The mats are secured to precast elongated panels disposed at the face of the earthen formation. The mats serve as anchors for the panels, as well as reinforcing means for the formation. Plural connections secure the mats along the length of the panels. However, the mats may slip within the earthen formation, and Hilfiker I does not teach or suggest utilizing any method to prevent slippage of the grid work mats.

Davis I discloses a connection system for connecting an upright soil retaining wall formed of modular facing panels with a number of soil reinforcement panels formed of parallel wires. The parallel wires terminate in enlarged bulbous portions at one end and are interconnected by perpendicular crossbars. The mesh units are connected in tiers to the retaining wall and rest in the soil behind the wall. The connection is made by a female member embedded into the back side of the panel with internal threads, into a male member which is threadedly received with an internal bore of a suitable size to pass the wires but not the bulbous portions which bear against the forward end of the bolts. With the wires seated within a corresponding male member, the facing panels and mesh units are connected by screwing the male member into the female member. Davis I suffers from the disadvantage of a complex and time consuming process of threading the male members into female members in order to connect the wire mesh reinforcement units to the retaining wall.

Davis II discloses a soil retaining system which includes an upright soil retaining wall of modular facing panels and a number of horizontal wire mesh reinforcement units. Each unit includes spaced parallel wires ending in hole forming loops and interconnected by perpendicular crossbars. The mesh units are connected in tiers to the retaining wall and rest in the soil behind the wall. The connection of each wire in a mesh unit is made by a clevis member embedded into the back side of the panel and a bolt and nut assembly or an elongated pin member for attaching the wires and the clevis. However, Davis II is a more complex and expensive system than the present invention.

Hilfiker II discloses a reinforced soil embankment having precast face panels with cantilevered sections extending into the embankment to support the panels in an upright condition. Soil reinforcing elements are secured to the panels to reinforce the embankment and secure the face panels in place. Connectors are provided for securing and reinforcing the elements to the panels. Loops, formed on the ends of the elements, are extended through eyes on the panels formed by wire segment having legs which extend into the face panels. However, Hilfiker II requires very precise alignment of the wire segments embedded in the face panels with the soil reinforcing elements. Thus, Hilfiker II provides a very inflexible method of attaching soil reinforcing elements to a retaining wall.

Review of each of the foregoing references reveals no disclosure or suggestion of a system or method as that described and claimed herein. Thus, it would be a distinct advantage to have a system and method which inexpensively and simply attaches supporting elements to retaining walls. It is an object of the present invention to provide such a system and method.

SUMMARY OF THE INVENTION

In one aspect, the present invention is a method of erecting a reinforced soil embankment. The method begins by providing a plurality of stackable face panels, each having a plurality of anchor links fixed within a back portion of the face panels. In addition, each of the anchor links forms a vertically oriented loop extending outwardly generally perpendicular to the back portion of the panels. Two legs extend laterally from each anchor link in opposite directions within the panels. A first tier of the face panels is disposed at the bottom of the embankment being erected. Soil is then back-filled behind the first tier of face panels to a level of the anchor links disposed within the first tier of panels. In the next step, a welded wire grid-work panel, which extends perpendicularly from the back of the wall into the soil embankment, is positioned so that a plurality of wire loops at the edge of the grid-work panel align with the vertical loops extending from the face panels. A connector member is then extended through the vertical loops of the anchor links and the wire loops of the grid-work panel. Next, soil is back-filled behind the first tier of face panels and over the anchor links, vertical loops, wire loops, and grid-work panel to a level at a top edge of the first tier of face panels. The method is repeated until the desired height of the embankment is attained.

In another aspect, the present invention is an attachment system for attaching a face panel to a welded wire grid-work attachment system. The system includes a plurality of anchor links fixed within a back portion of the face panel. Each of the anchor links forms a vertical loop extending outwardly generally perpendicular to the back portion of the face panel. Two legs extend laterally from each anchor link within the face panel. The welded wire grid-work panel includes a plurality of wire loops disposed at one end of the grid-work panel and spaced apart sufficiently to align with the anchor links when the grid-work panel is connected to the face panel. In addition, the system includes a connector rod extensible through the vertical loops of the anchor links and the wire loops of the grid-work panel to connect the grid-work panel to the face panel.

In still another aspect, the present invention is an improved retaining wall link and loop combination. The combination includes a face panel having a back portion and an anchor link fixed within the back portion of the face panel. The anchor link includes a vertically oriented loop extending outwardly generally perpendicular to the back portion of the face panel and two legs extending laterally from the anchor link within the face panel. The combination also includes a welded wire grid-work panel having a first end and a wire loop disposed at the first end of the welded wire grid-work panel. Additionally, the combination includes a connector rod extensible through the vertical loop of the anchor link and the wire loop of the grid-work panel to connect the grid-work panel to the face panel.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

An improved method and system for attaching a welded wire gridwork panel to a plurality of face panels of a retaining wall is disclosed.

Figure 1:
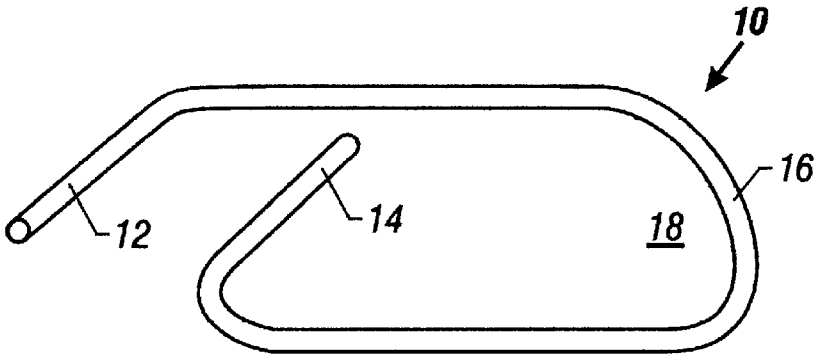
FIG. 1 illustrates a perspective view of a preferred embodiment of an anchor link of the present invention.

FIG. 1 illustrates a perspective view of a preferred embodiment of an anchor link 10 of the present invention. The anchor link includes two spaced apart L-shaped legs, an upper leg 12 and a lower leg 14. The upper leg and lower leg are joined by a U-shaped projecting end 16. The anchor link forms a vertical loop 18 to which welded wire grid-work panels are attached.

Figure 2:
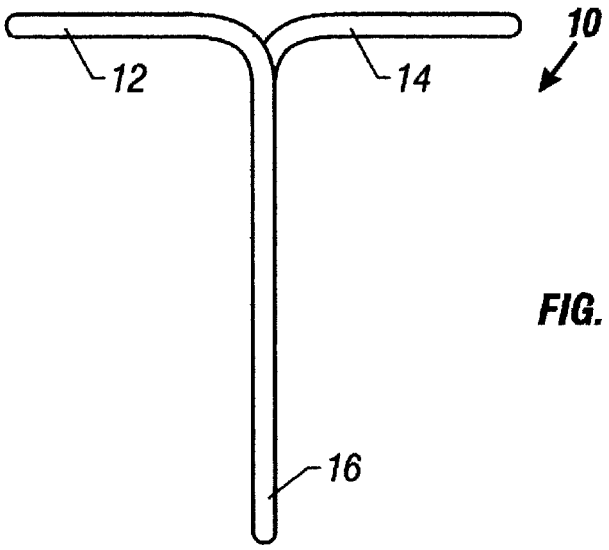
FIG. 2 illustrates a top plan view of the anchor link of FIG. 1.

FIG. 2 illustrates a top plan view of the anchor link 10 of FIG. 1.

Figure 3:
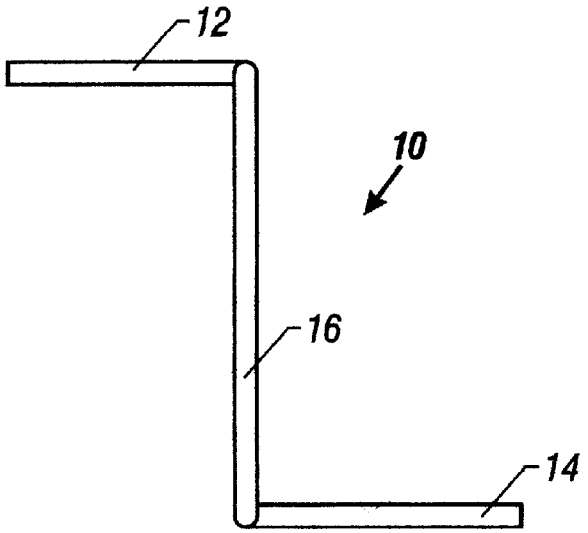
FIG. 3 illustrates a front elevational view of the anchor link of FIG.

FIG. 3 illustrates a front elevational view of the anchor link 10 of FIG. 1.

Figure 4:
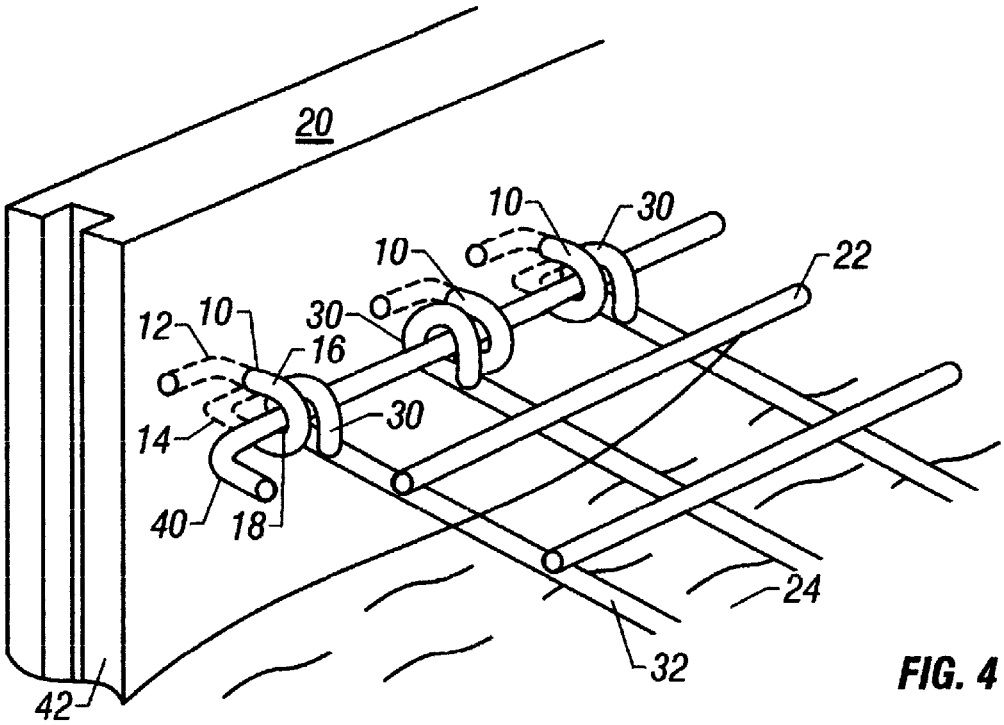
FIG. 4 illustrates a perspective view of a plurality of anchor links fixed within a face panel connected to a wire grid-work panel.

FIG. 4 illustrates a perspective view of a plurality of anchor links 10 fixed within a face panel 20 and connected to a welded wire grid-work panel 22. The grid-work panel extends perpendicularly from the back of the retaining wall into soil 24. A plurality of wire loops 30 are formed at an edge of the grid-work panel, by bending the ends of a plurality of wire grids 32 into a loop and welding the end of each wire grid back into itself. The loops 30 are then positioned against the back of the face panel and vertically aligned with the vertical loops 18 protruding from the face panel. A connector rod 40 is passed through the loop 18 of each anchor link 10, and the wire loop 30 of the welded wire grid-work panel 22 to secure the grid-work panel to the face panel 20 when the anchor links and wire loops are properly aligned.

Figure 5:
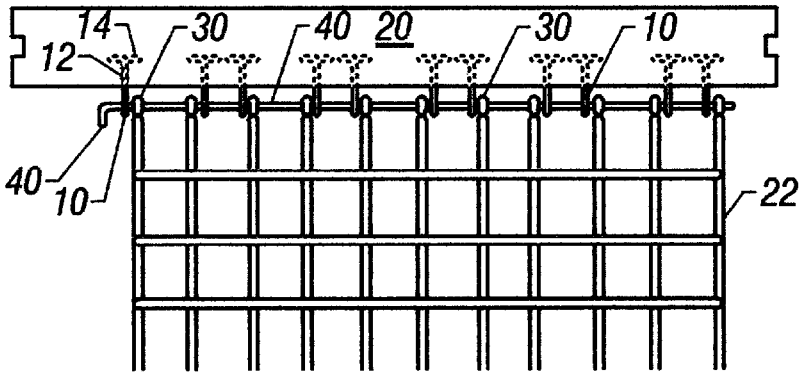
FIG. 5 illustrates a top view of the plurality of anchor links connected to the wire grid-work.

FIG. 5 illustrates a top view of the plurality of anchor links connected to the wire grid-work. The preferred sequence is an anchor link 10, wire loop 30, wire loop, anchor link, anchor link, wire loop, wire loop, anchor link, anchor link, etc. This particular sequence ensures that the welded wire grid-work panel 22 does not shift laterally once the anchor links and wire loops are properly aligned. However, other sequences may be utilized while allowing only minimal lateral shifting.

A connector rod 40 is passed through the loop 18 of each anchor link 10, and the wire loop 30 of the welded wire grid-work panel 22 to secure the grid-work panel to the face panel 20 when the anchor links and wire loops are properly aligned.

Still referring to FIG. 5, the outwardly projecting legs (upper leg 12 and lower leg 14) of each anchor link 10 extend laterally within the face panel 20 to anchor the anchor link to the panel and reduce the probability of the anchor link being pulled out of the panel.

Figure 6:
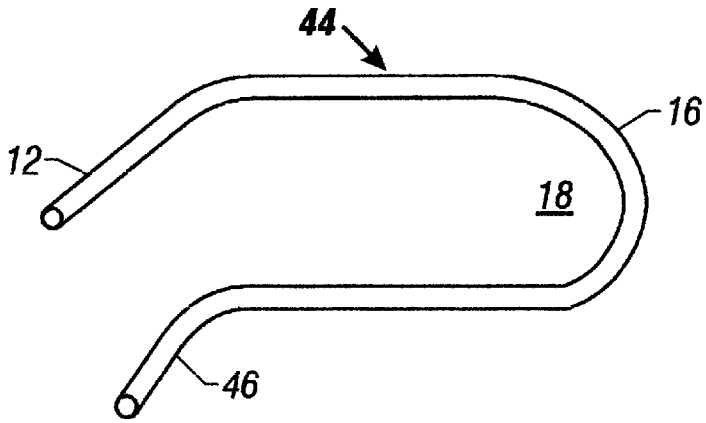
FIG. 6 illustrates a perspective view of an alternate embodiment of an anchor link of the present invention.

FIG. 6 illustrates a perspective view of an alternate embodiment of an anchor link 44 of the present invention. The anchor link 44 includes the upper leg 12, the U-shaped projecting end 16, the vertical loop 18 and a lower leg 46. The anchor link 44 is similar to the anchor link 10 with the exception of the lower leg 46 extending in the same direction from the anchor link 44 as the upper leg 12. In other embodiments, the upper leg and lower leg may extend in various directions in relation to the anchor link.

Figure 7:
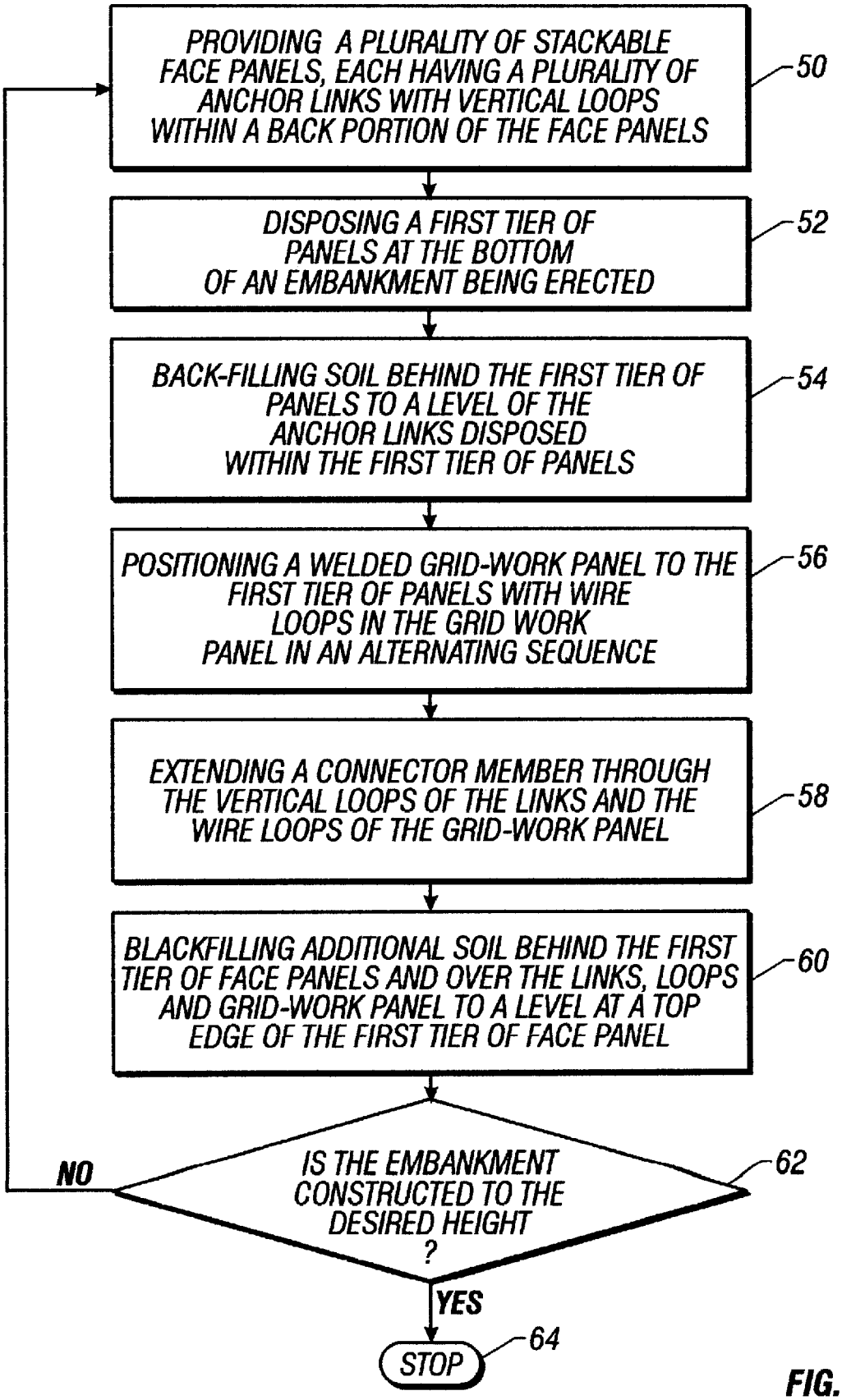
FIG. 7 is a flow chart illustrating the steps for erecting a reinforced soil embankment according to the teachings of the present invention.

FIG. 7 is a flow chart illustrating the steps for erecting a reinforced soil embankment in accordance with the teachings of the present invention. With reference to FIGS. 1–5, and 7, the steps of the method will now be described. Beginning with step 50, a plurality of stackable face panels 20, each having a plurality of anchor links 10 fixed within a back portion 42 of the panels are provided. Each of the anchor links forms the vertical loop 18 extending outwardly generally perpendicular to the back portion of the face panels. Additionally, in the preferred embodiment, each anchor link includes the upper leg 12 and the lower leg 14 extending laterally from each link in opposite directions within the panel. However, in other embodiments, the upper leg and lower leg may extend laterally from each link in other directions such as in the same direction within the panel (FIG. 6). Next, in step 52, a first tier of the panels is disposed at the bottom of an embankment being erected. In step 54, soil 24 is back-filled behind the first tier of the panels to the level of the anchor links disposed within the first tier of panels. In step 56, the welded wire grid-work panel 22, which extends perpendicularly from the back of the wall into the soil, is positioned so that the plurality of wire loops 30 at the edge of the grid-work panel align with the vertical loops extending from the face panels in an alternating sequence discussed above. Next, in step 58, the connector rod 40 is extended through the vertical loops of the anchor links and the wire loops of the grid-work panel. In step 60, more soil is backfilled behind the first tier of face panels and over the anchor links, vertical loops, wire loops, and grid-work panel to a level at a top edge of the first tier of face panels. In step 62, it is determined whether or not the desired height is attained on the embankment. If the desired height of the embankment is not reached, then the method moves to step 50 where an additional plurality of stackable face panels, each having a plurality of anchor links fixed within a back portion of the panels is provided. If, however, the desired height is attained on the embankment, then the method moves to step 64 where the method is stopped.

It is thus believed that the operation and construction of the present invention will be apparent from the foregoing description. While the system and method shown and described has been characterized as being preferred, it will be readily apparent that various changes and modifications could be made therein without departing from the scope of the invention as defined in the following claims.

What is claimed is:

1. A method of erecting a reinforced soil embankment, the method comprising the steps of:

providing a plurality of stackable face panels, each having a plurality of anchor links fixed within a back portion of the face panels, each of the anchor links forming a vertically oriented loop extending outwardly generally perpendicular to the back portion of the face panels and having two legs extending laterally from each link in opposite directions within the face panels;

disposing a first tier of face panels at a bottom end of the embankment being erected;

back-filling soil behind the first tier of face panels up to a bottom edge of the plurality of anchor links disposed within the first tier of face panels;

positioning a welded wire grid-work panel, extending perpendicularly from the back portion of face panels onto the back-filled soil embankment, so that a plurality of wire loops at an edge of the grid-work panel align with the vertically oriented loops;

extending a connector member through the vertical loops of the anchor links and the wire loops of the grid-work panel; and back-filling additional soil behind the first tier of face panels and over the anchor links, vertical loops, wire loops, and grid-work panel to a level at a top edge of the first tier of face panels.

2. The method of claim 1 further comprising, after back-filling soil behind the first tier of face panels, the step of continuing to stack additional tiers of face panels, back-filling soil, aligning additional grid-work panels, and extending connector members to construct the embankment to a desired height.

3. The method of claim 1 wherein the step of aligning a welded wire grid-work panel to the first tier of face panels with wire loops includes aligning the vertical loops with the wire loops in an alternating sequence.

4. An attachment system for attaching a face panel to a welded wire grid-work panel, the system comprising:

a plurality of anchor links fixed within a back portion of the face panel, each of the anchor links forming a vertically oriented loop extending outwardly generally perpendicular to a back portion of the face panel and having two legs extending laterally from each link within the face panel;

a plurality of wire loops disposed at one end of the welded wire grid-work panel and spaced apart sufficiently to align with the anchor links when the grid-work panel is connected to the face panel; and a connector rod extensible through the vertical loops of the anchor links and the wire loops of the grid-work panel to connect the grid-work panel to the face panel.

5. The system of claim 4, wherein the two legs extend laterally from each link in opposite directions within the face panel.

6. The system of claim 4, wherein the plurality of wire loops is spaced sufficiently apart to align with the anchor links in an alternating sequence with the anchor links when the grid-work panel is connected to the face panel.

7. An improved retaining wall link and loop combination, the combination comprising:

a face panel having a back portion;

an anchor link fixed within the back portion of said face panel, said anchor link comprising:

a vertically oriented loop extending outwardly generally perpendicular to the back portion of said face panel; and two legs extending laterally from said anchor link within said face panel;

a welded wire grid-work panel having a first end;

a wire loop disposed at the first end of said welded wire grid-work panel; and a connector rod extensible through the vertical loop of said anchor link and said wire loop of said grid-work panel to connect said grid-work panel to said face panel.

8. The improved retaining wall link and loop combination of claim 7 wherein the two legs extend laterally from said anchor link in opposite directions within said face panel.

9. The combination of claim 7, further comprising:

a plurality of anchor links fixed within the back portion of said face panel;

a plurality of wire loops disposed on the first end of said welded wire grid-work panel; and wherein the connector rod is extended through said plurality of wire loops and said plurality of anchor links to connect said grid-work panel to said face panel.

* * * * *